/10/86 4,593,819

United States Patent [19]

Will

[11] Patent Number: 4,593,819

[45] Date of Patent: Jun. 10, 1986

[54] COVERED PILL TRAY AND SUPPORT THEREFOR

[76] Inventor: Malcolm Will, 3125 Woodbridge Ave., Edison, N.J. 08837

[21] Appl. No.: 614,825

[22] Filed: May 29, 1984

[51] Int. Cl.[4] ..... B65D 1/36; B65D 85/56; B65D 85/62; B65D 21/02

[52] U.S. Cl. ..... 206/538; 206/534; 206/534.1; 206/501; 206/514; 206/558; 220/306; 220/23.83

[58] Field of Search ..... 206/44.11, 528, 534, 206/534.1, 538, 540, 557, 558, 505, 507, 45.24, 501, 514; 116/308; 220/306, 23.86, 23.83; 229/2.5 R

[56] References Cited

U.S. PATENT DOCUMENTS

| | | | |
|---|---|---|---|
| 2,506,385 | 5/1950 | Roamer | 206/44.11 |
| 3,032,186 | 5/1962 | Jenkins | 206/571 |
| 3,145,841 | 8/1964 | McGuire | 206/571 |
| 3,225,913 | 12/1965 | Lee | 206/534 |
| 3,353,708 | 11/1967 | Darls | 220/306 |
| 3,627,122 | 12/1971 | Garbe, Jr. | 116/308 |
| 3,630,171 | 12/1971 | Huck | 206/539 |
| 3,675,620 | 7/1972 | Baustin | 116/308 |
| 3,838,806 | 10/1974 | Dogliotti | 229/2.5 R |
| 4,038,937 | 8/1977 | Möe | 206/538 |
| 4,039,080 | 8/1977 | Cappuccilli | 206/538 |
| 4,053,280 | 10/1977 | Salisbury | 206/363 |
| 4,318,477 | 3/1982 | Kerpe | 116/308 |
| 4,473,156 | 9/1984 | Martin | 206/534 |

FOREIGN PATENT DOCUMENTS

| | | | |
|---|---|---|---|
| 2431443 | 3/1980 | France | 206/534 |

*Primary Examiner*—William Price
*Assistant Examiner*—Brenda J. Ehrhardt
*Attorney, Agent, or Firm*—Peter L. Klempay

[57] ABSTRACT

A tray of rectangular configuration having an array of open-topped compartments serves to hold a supply of medication arranged by day and time of taking. Associated with the tray is a support base having provision for storage of medication containers. A case may be provided for the tray and includes a cover to permit the tray to be carried without danger of the pills moving from the individual compartments.

Preferably, the assembly is made by a plastic thermoforming process and an improved latch mechanism formed of mating walls of V-shaped configuration is provided.

11 Claims, 21 Drawing Figures

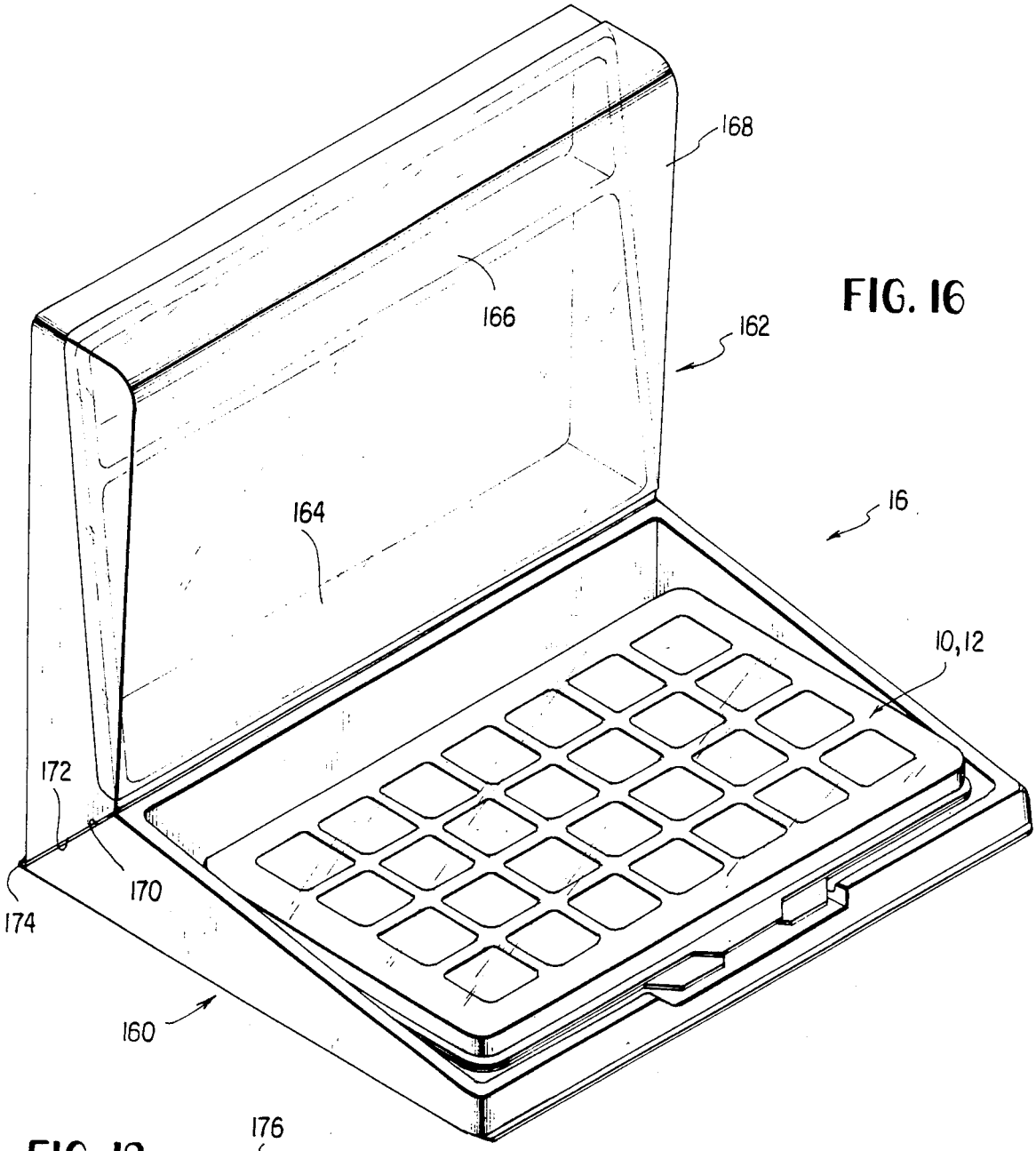
FIG. 16
FIG. 18
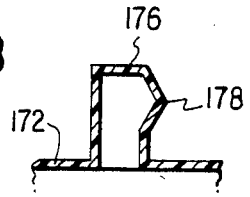
FIG. 19
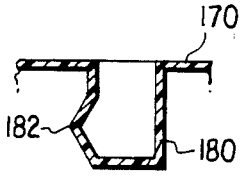
FIG. 21
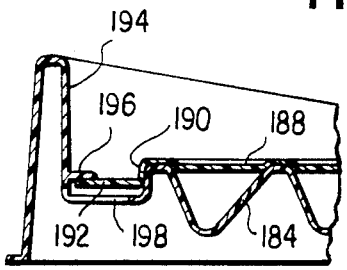

COVERED PILL TRAY AND SUPPORT THEREFOR

The present invention pertains to trays for holding individual dosages of pills, tablets or the like and, more particularly, to such trays in combination with provision for storage of the medication containers.

BACKGROUND OF THE INVENTION

For many individuals, it is necessary to take medication on a routine basis, typically, several times each day. In order to assist the individual in remembering when a particular pill or tablet is to be taken, compartmented trays for holding the pills in an organized manner have been devised. U.S. Pat. No. 4,039,080, Capuccilli, for example, discloses a tray having a four by seven array of compartments for holding a week long supply of medication further arranged by the periods at which the medication is to be taken. A similar arrangement is shown in U.S. Pat. No. 4,038,937, Moe. Another compartmented pill tray is disclosed in U.S. Pat. No. 3,700,095, Dangles et al, in which the compartments are arranged in concentric circles with a central recess for holding a single pill bottle.

It is the primary object of the present invention to provide a compartmented pill tray assembly having provision both for holding a plurality of individual dosages of pills, tablets or the like and for storage of one or more medication containers.

A further object of the invention is the provision of such a tray assembly in which the compartmented tray is separable from the storage compartment.

It is another object of the invention to provide a compartmented pill tray assembly which is adapted to be formed by the vacuum thermoforming of plastic material.

It is also an object of the invention to provide such a thermoformed plastic compartmented pill tray assembly incorporating a improved latch mechanism.

Another object of the invention is the provision of a compartmented pill tray assembly characterized by its durability and simplicity of construction.

BRIEF SUMMARY OF THE INVENTION

The above and other objects of the invention are achieved by the provision of a compartmented pill tray assembly having a molded plastic tray with open-topped compartments arranged in a uniform array of columns and rows, a column being provided for each day of the week and a row, for each interval at which medication is to be taken; a case for receiving the tray and including a hinged cover, preferrably of transparent plastic material; and a supporting base having a recess for releaseably holding the tray and case assembly and one or more compartments for storage of medicine bottles.

The tray cover may include a latch assembly formed of mating walls each having a V-shaped cross-sectional configuration. Similarly configured arrangements may be employed to releaseably connect the tray and case assembly to the supporting base.

For a more complete understanding of the invention and the objects and advantages thereof which will become apparent hereinafter, reference should be had to the accompanying darwings and the following detailed description wherein preferred embodiments of the invention are illustrated and described.

BRIEF DESCRIPTION OF THE DRAWINGS

In the drawings:

FIG. 16 is a perspective view of a third embodiment of the supporting base;

FIGS. 18 and 19 are fragmentary cross-sectional views taken on the lines 18—18 and 19—19, respectively, of FIG. 17;

FIG. 21 is a fragmentary cross-sectional view taken on the line 21—21 of FIG. 20.

DETAILED DESCRIPTION OF THE PREFERRED EMBODIMENTS

Figure 17:
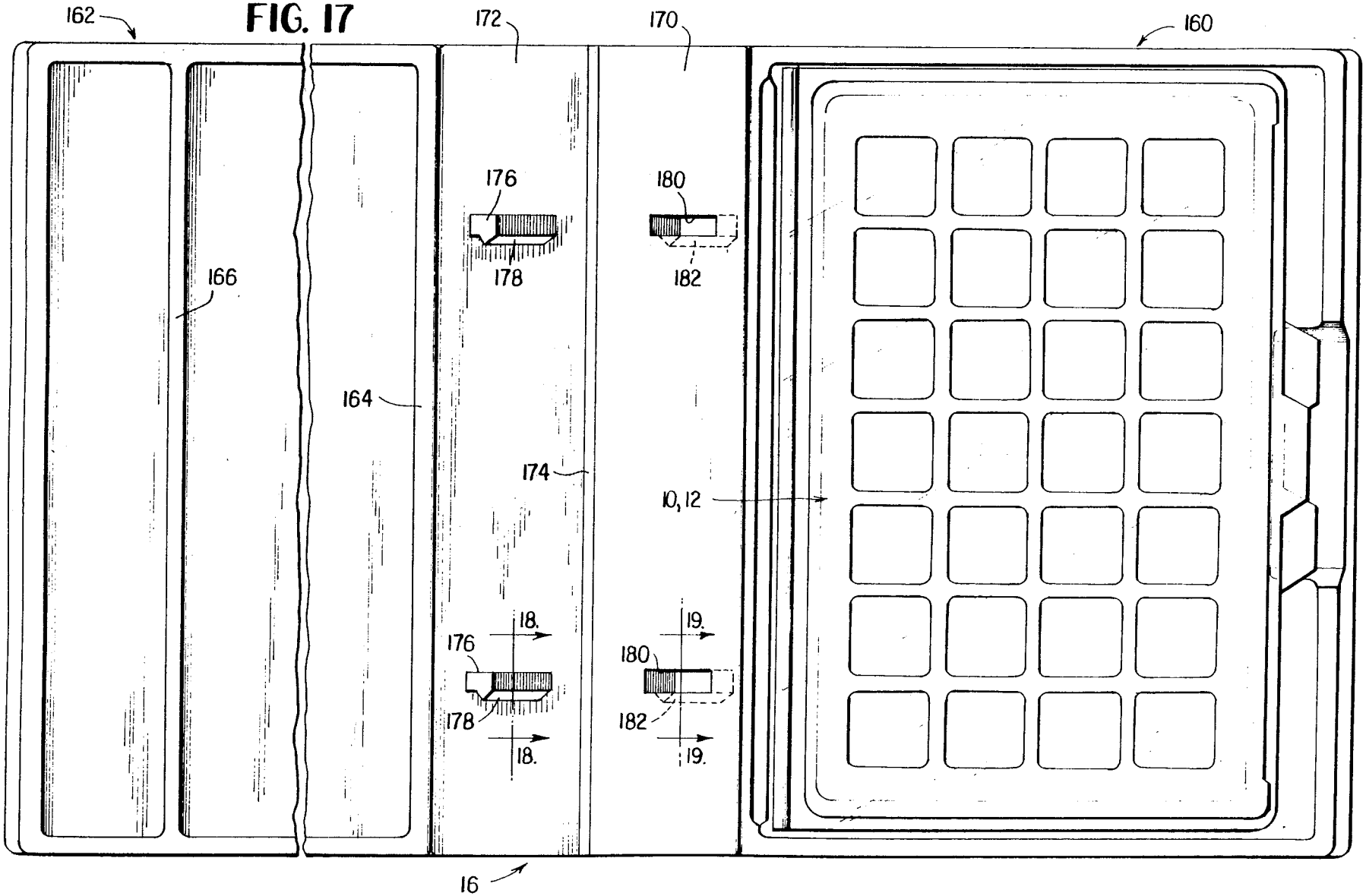
FIG. 17 is a plan view of the supporting base of FIG. 16 in its as-molded position.

In the embodiments of the invention shown in FIGS. 1-19, the pill tray assembly of the present invention is of three part construction, including a compartmented tray 10, a case 12, and a supporting base 14 (FIGS. 9-12), 15 (FIGS. 13-15), or 16 (FIGS. 17-19).

Figure 1:
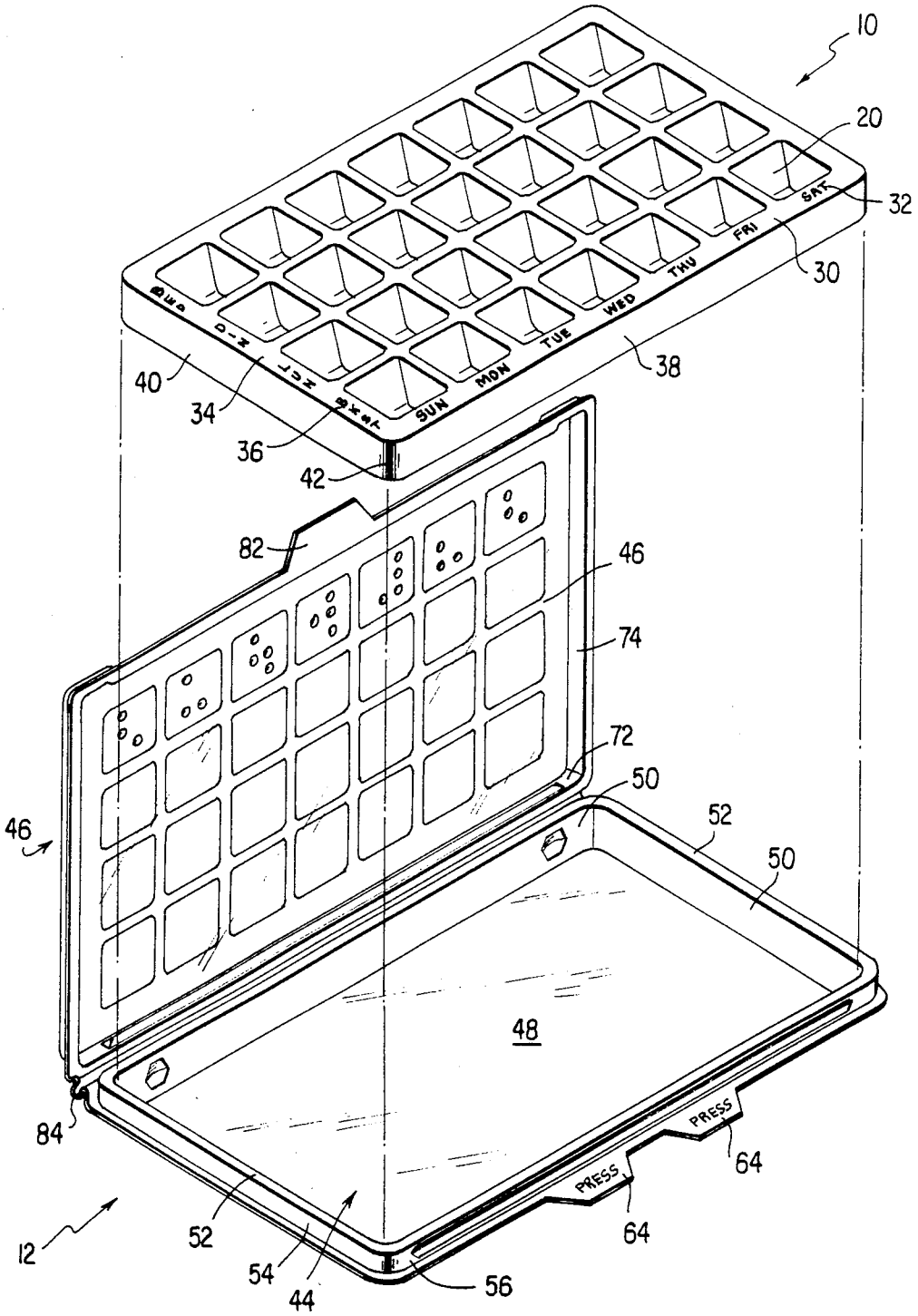
FIG. 1 is a perspective view of the compartmented pill tray and cover assembly of the present invention.
Figure 2:
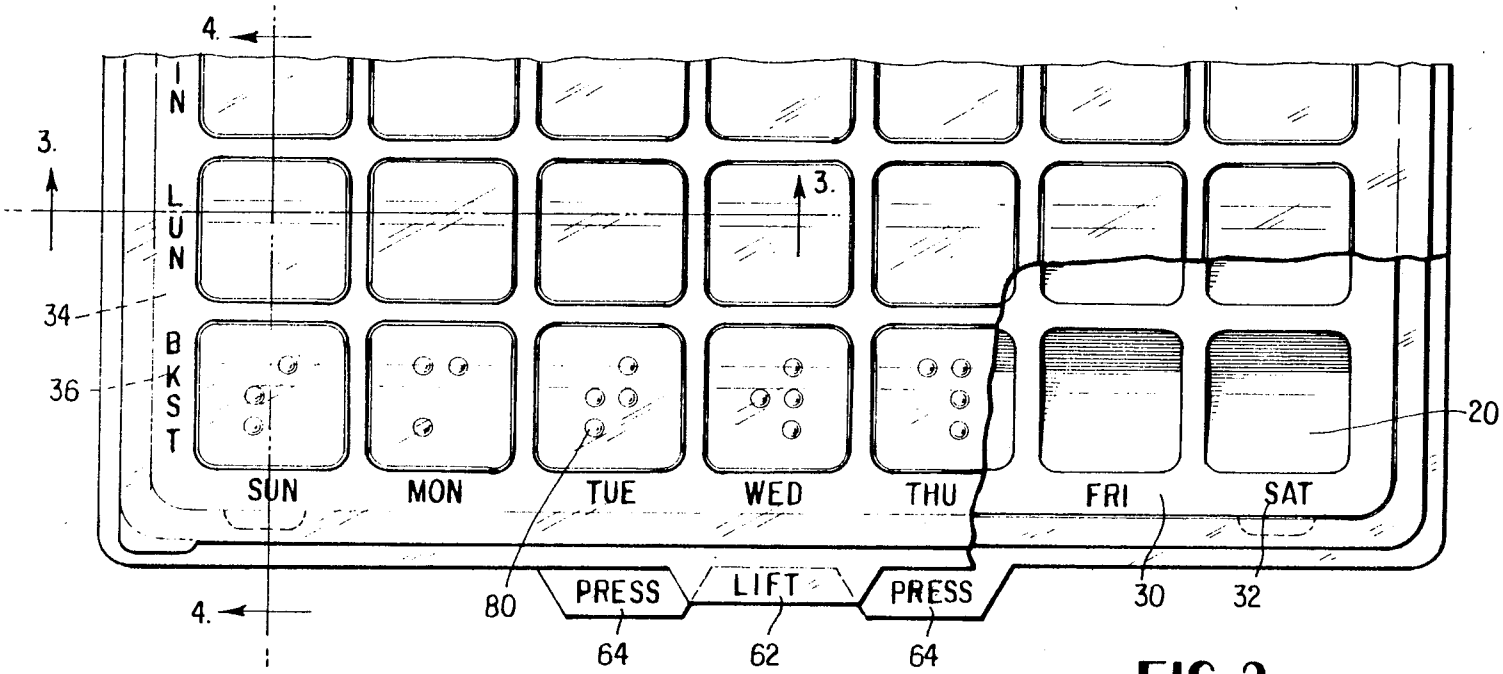
FIG. 2 is a fragmentary plan view thereof.
Figure 4:
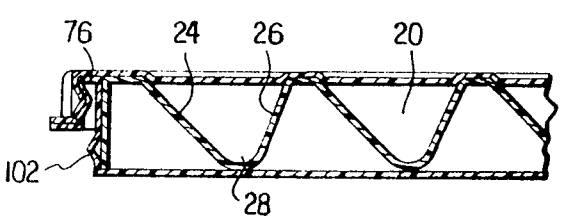
FIGS. 3 and 4 are fragmentary cross-sectional views taken on the lines 3—3 and 4—4, respectively, of FIG. 2.
Figure 3:
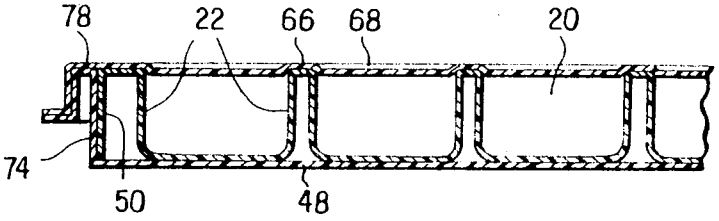
Figure 5:
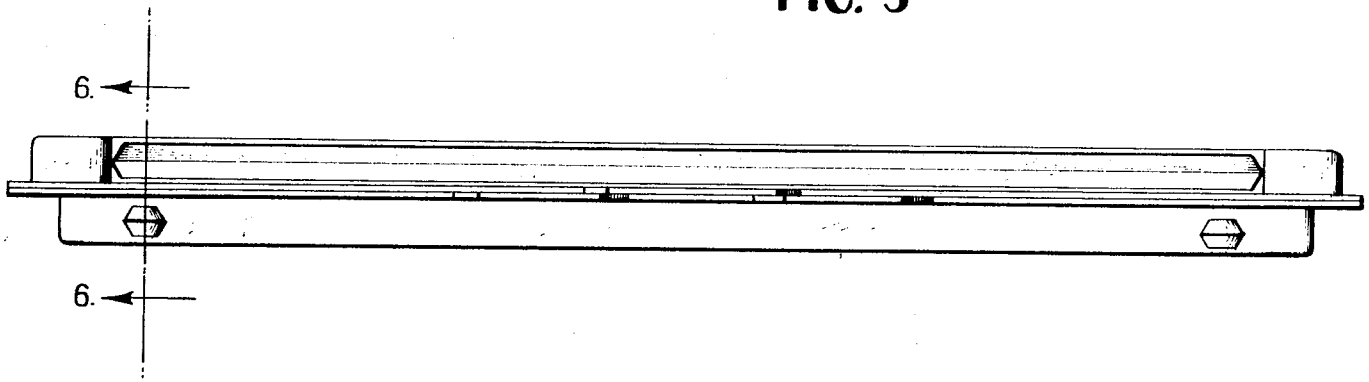
FIG. 5 is a front elevational view of the tray and case assembly.

The tray is of rectangular configuration in plan and is formed with a four by seven array of compartments 20 each having generally parallel side walls 22 and, as can be seen from FIG. 4, sloping front and rear walls 24, 26, respectively, with the rear walls being more steeply inclined than the front walls, the front and rear walls meeting in a smoothly rounded bottom wall 28, the juncture of the side walls 22 and the bottom wall 28 being radiused so that even small tablets may be easily removed from the compartments. Preferably, the forward top edge 30 of the tray is provided with legends 32 designating the days of the week in alignment with the columns of compartments and one lateral top edge 34, with legends 36 designating times of day or intervals at which medication is to be taken in alignment with the rows of compartments. The tray further includes peripheral walls 38, 40 meeting in radiused corners 42 and extending the same depth as the compartments 20. The tray may be formed of high impact polystyrene by a vacuum thermoforming process.

As was mentioned above, the tray is received in a case 12 which includes a base portion 44 and a hinged cover portion 46. The base portion of the case is provided with a bottom wall 48 and upstanding peripheral walls 50 of substantially the dimensions of the tray 10 to closely receive the tray. Around the entire upper end of the peripheral walls 50 there is provided an outwardly projecting lip 52 from the outer edge of which downwardly extending side walls 54, front wall 56 and rear wall 58 depend, these walls extending approximately one-half the height of the peripheral walls 50. As can be seen from FIG. 3, the depending side walls 54 are straight while, as is shown in FIG. 4, the front and rear depending walls 56, 58 are of V-shaped cross-section forming a part of the latch arrangement to be described hereinafter. The depending side walls 54 and the depending front wall 56 terminate in outwardly projecting flanges 60, 62, respectively, the flange of the front wall further including a pair of tabs 64 on opposite sides of the midpoint thereof.

The cover portion 46 of the case has a top wall 66 formed with shallow depressions 68 corresponding in size and position to the compartments 20 of the tray 10 and downwardly projecting front, rear and side peripheral walls 70, 72, 74, respectively, these walls being of substantially the same depth as the outer, depending walls 56, 58 of the base portion 44. Outwardly projecting flanges 76, 78 are provided at the lower ends of the front and side walls 70, 74, respectively, the the front wall flange including a tab 82 at the midpoint thereof. As with the base portion, the front and rear depending walls 70, 72 are of V-shaped cross-section along a substantial portion of the length thereof while the side walls 74 are straight. Completing the description of the cover portion the frontmost row of depressions may be provided with raised dots 80 to indicate the days of the week in Braille.

Figure 6:
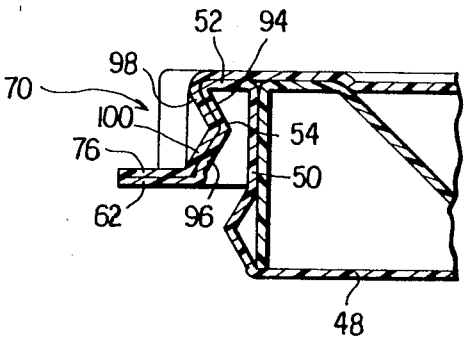
FIG. 6 is a fragmentary cross-sectional view taken on the line 6—6 of FIG. 5 and on an enlarged scale relative thereto.
Figure 9:
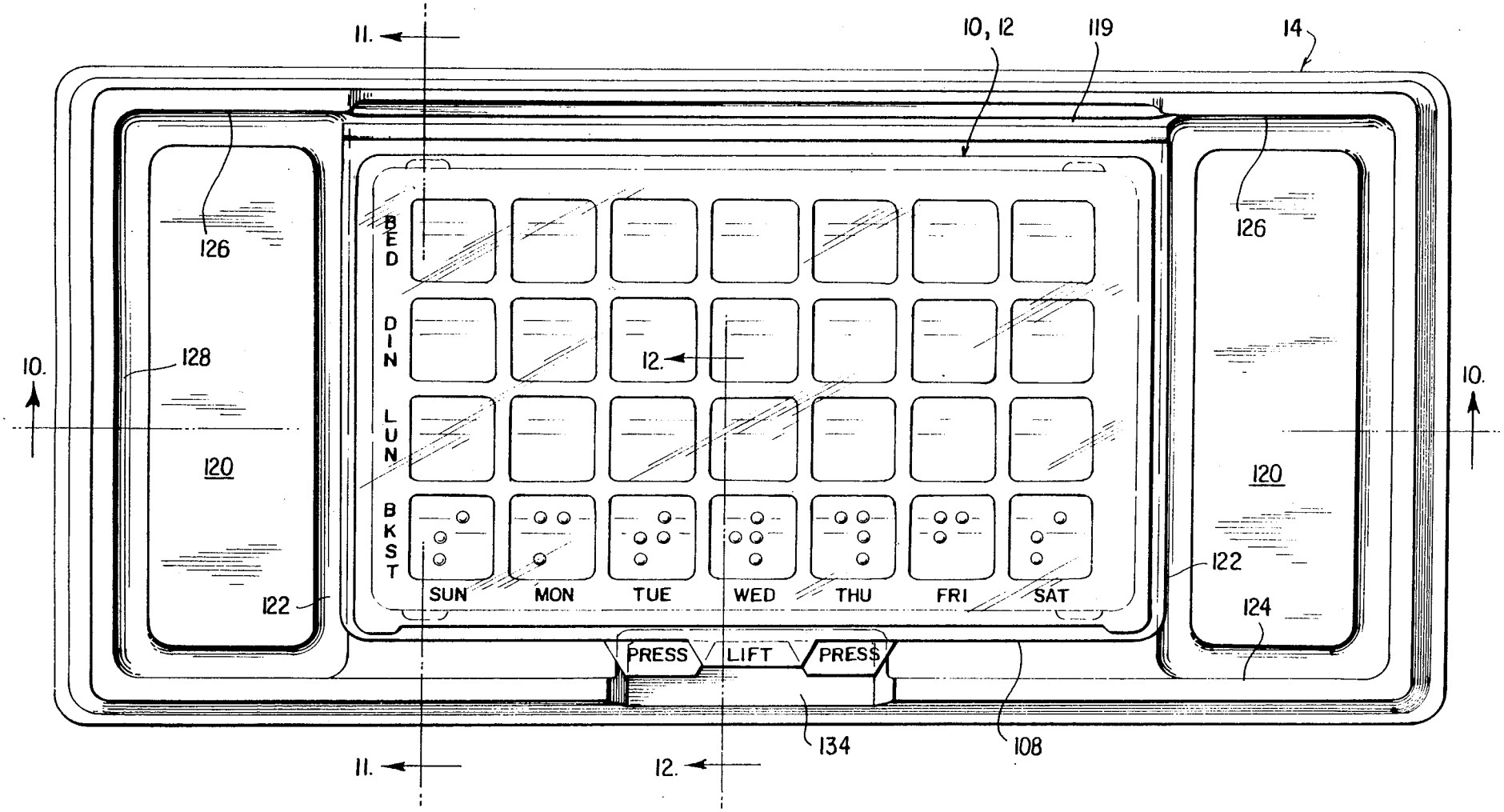
FIG. 9 is a plan view of the tray and cover assembly of FIGS. 1-5 in combination with a first embodiment of the supporting base therefor.
Figure 10:
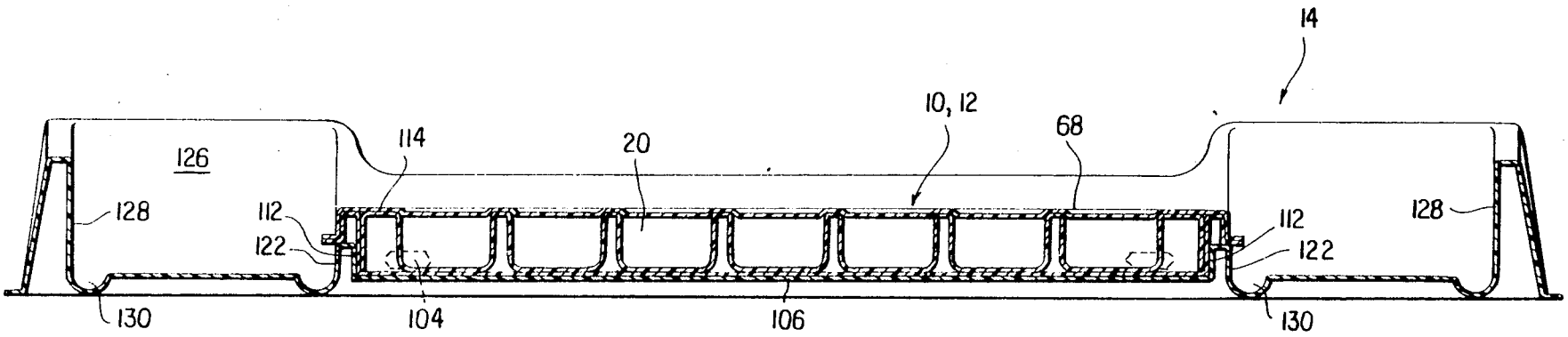
FIGS. 10 and 11 are cross-sectional views taken on the lines 10—10 and 11—11, respectively, of FIG. 9.
Figure 12:
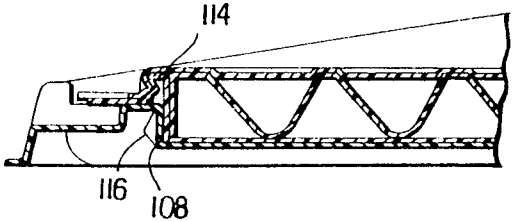
FIG. 12 is a fragmentary cross-sectional view taken on the line 12—12 of FIG. 9.
Figure 11:
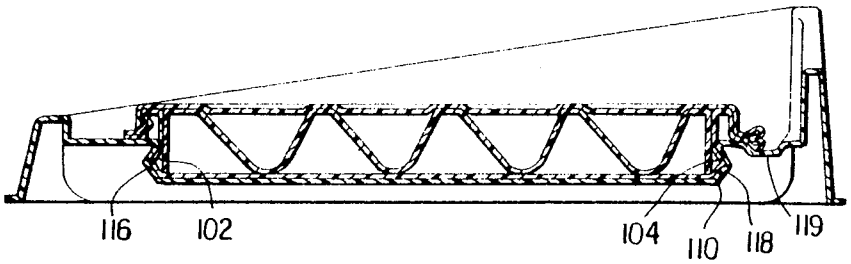

Joining the base portion 44 and the cover portion 46 is an integrally formed hinge 84, illustrated on an enlarged scale in FIG. 6. The hinge extends between the lower edge of the depending rear wall 58 of the base portion and the lower edge of the outer, depending rear wall 72 of the cover portion along the entire length thereof and includes lower and upper portions 86, 88 of arcuate cross-section and a connecting, intermediate portion 90 of reverse curvature relative to the portions 86, 88.

As was mentioned above, the front and rear depending walls 56, 58 of the base portion and the corresponding walls 70, 72 of the cover portion are of V-shaped cross-section along substantially the entire length thereof. This arrangement, which is shown in detail in FIG. 6, provides a latching arrangement for holding the cover portion closed on the base portion and the compartmented tray carried thereby. The V-shaped portion of the depending wall 54 of the base portion 44 consists of upper and lower wall portions 94, 96, respectively, of equal height forming equal angles with the vertical. Likewise, the V-shaped portion of the front wall 70 of the cover portion consists of upper and lower wall portions 98, 100 again of equal height and forming equal angles, the angles formed by the cover and base wall portions being equal. The corresponding V-shaped portions of the rear walls are similarly formed. When the cover portion is closed upon the base portion, the V-shaped portions of the cover engage the V-shaped portions of the base walls to form an effective latch for the case. Opening of the case is effected by pressing downwardly on the tabs 64 of the base portion while lifting the tab 80 of the cover portion.

Figure 8:
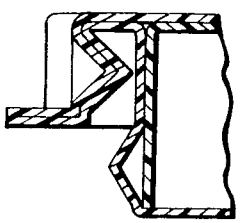
FIGS. 7 and 8 are fragmentary cross-sectional views corresponding to that of FIG. 6 and showing modifications of the latch structure.
Figure 7:
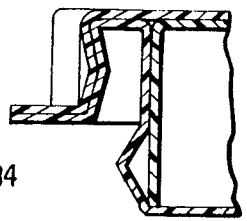

By selecting the angle formed by the wall portions 94, 96 and 98, 100, the amount of resistance encountered in opening and closing the case can be selected. Thus, FIG. 7 illustrates an arrangement having a shallower angle and, accordingly, decreased resistance to opening and closing while FIG. 8 illustrates a greater angle requiring more effort to open or close the latch. The angle may be varied from approximately 7° to approximately 45°.

Outwardly extending projections 102, 104 are provided on the front and rear walls of the base portion, these projections being located on the lower portions of the walls so as to be below the plane of the flanges 60, 62 and adjacent the corners of the case. As will be described hereinafter, these projections serve to releaseably retain the case and tray assembly in the supporting base 14, 15 or 16, the base having cooperating recesses for this purpose. Preferrably, these projections and recesses are of the same V-shaped configuration as the latch portions described above.

As with the tray 10, the case is preferrably formed by a vacuum thermoforming process. Clear polyvinyl chloride is a suitable material.

Referring now to FIGS. 9–12, a first embodiment of the supporting base 14 will be described. The supporting base serves to hold the tray 10 and cover 12 assembly and to provide storage for a plurality of bottles or other medicine containers. The base 14 has a bottom wall including a centrally located rectangular region 106 bounded by upwardly extending front, rear and side walls 108, 110, 112 to define a recess for receiving the tray and cover assembly. The walls terminate in a horizontal rim 114 and are of a height such that, when the cover and tray assembly is positioned in the region 106, the flanges 76, 78 of the cover rest on the rim 114. As can be seen from FIG. 10, the flanges 76, 78 of the cover project beyond the rim 114 to facilitate removal of the cover and case assembly from the base when desired. A groove or channel 119 is formed in the bottom wall rearwardly of the centrally located region 106 to provide clearance for the hinge 84 of the cover. Recesses 116, 118 are formed in the front and rear walls 108, 110 in alignment with the projections 102, 104 of the cover to permit the cover and tray assembly to be snapped into the supporting base. Laterally of the centrally located region 106, the supporting base has two recessed regions 120 bounded by interior walls 122 extending downwardly from the rim 114 and by front, rear and side walls 124, 126, 128 of the support base. The bottom walls of the recessed regions may be formed with ribs 130 for strength. These recessed regions provide storage space for medicine containers. The front wall 124 of the support base is notched, as indicated by numeral 132, to receive the tabs 64 and 82 of the case 12.

Figure 13:
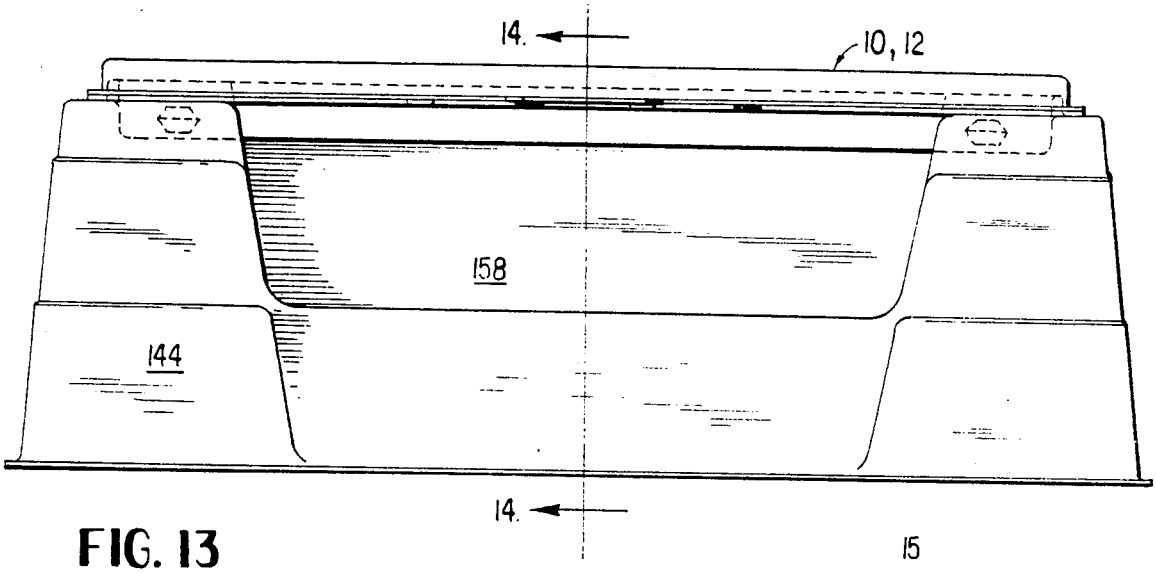
FIG. 13 is a front elevational view of the tray and cover assembly of FIGS. 1-5 in combination with a second embodiment of the supporting base therefor.
Figure 14:
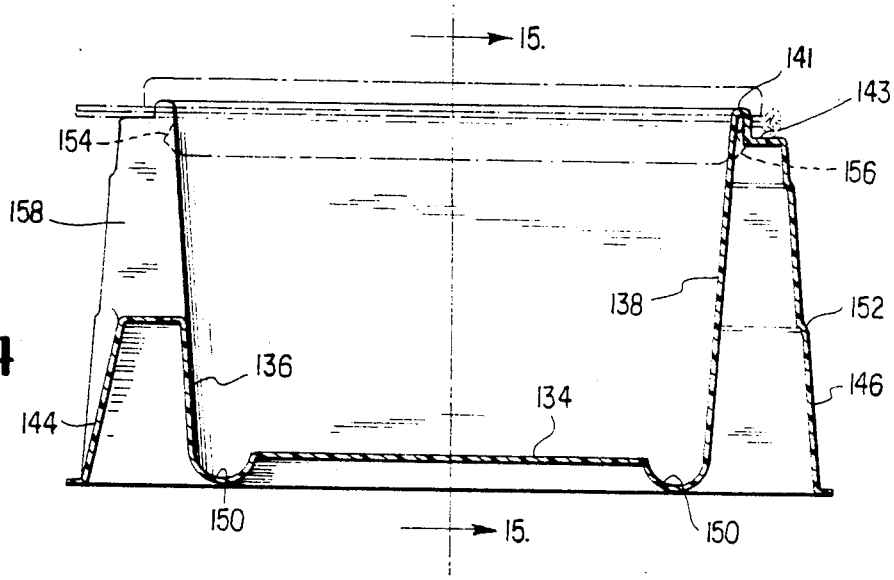
FIG. 14 is a cross-sectional view taken on the line 14—14 of FIG. 13 and showing the tray and cover assembly in phantom outline.
Figure 15:
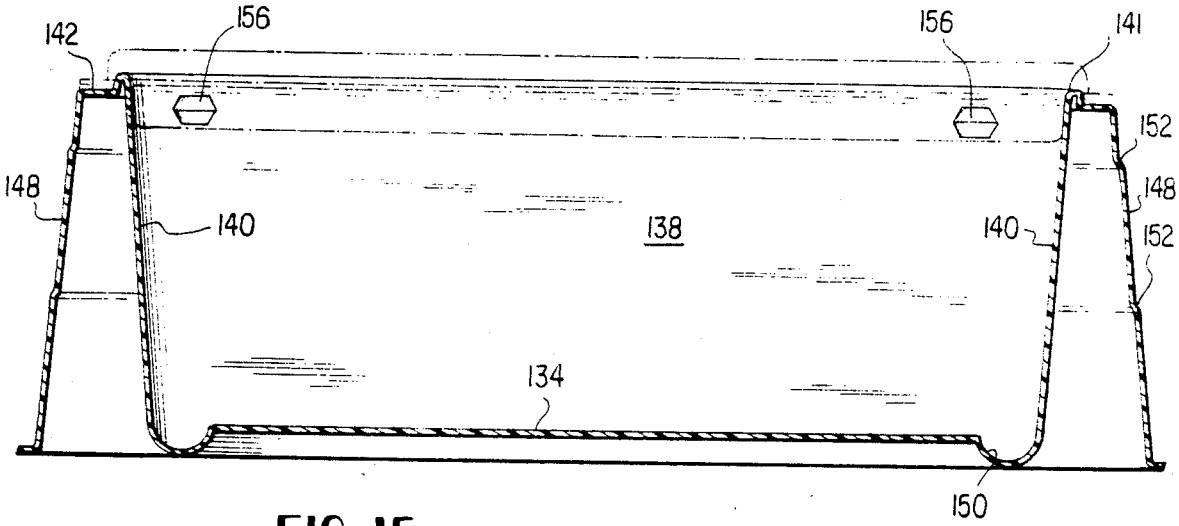
FIG. 15 is a cross-sectional view taken on the line 15—15 of FIG. 14 and showing the tray and cover assembly in phantom outline.

A second embodiment of the supporting base 15 is shown in FIGS. 13–15. The base unit 15 is rectangular in plan with a bottom wall 134, interior front, rear and side walls 136, 138, 140 extending upwardly therefrom and terminating in an upper wall 142, and exterior front, rear and side walls 144, 146, 148. Along the inner periphery of the upper wall, an upwardly projecting rib 141 is provided, this rib being received between the peripheral walls 50 and the downwardly extending side, front and rear walls 52, 54 and 56 of the case. Rearwardly of the rib 141, the rear upper wall of the base unit is stepped downwardly, as indicated at 143, to provide clearance for the cover hinge 84. Ribs 150 may be provided for imparting rigidity to the bottom wall 134 and the exterior walls may be stepped, as indicated by numeral 152, for the same purpose. The upper ends of the interior walls 136, 138, 140 define an opening for receiving the tray 10 and cover 12 assembly with the case flanges resting on the upper wall 142 outwardly of the rib 141. Recesses 154, 156, preferrably of V-shaped configuration, are formed in the front and rear interior walls, respectively, for engagement with the projections 102, 104 of the case 12. The front walls 136, 144 of the base unit are formed with an opening 158 extending approximately one-half of the height and a substantial portion of the length thereof. The interior of the unit 15 provides storage space for medicine containers and the opening 158 serves both to provide access thereto and to permit removal of the tray and cover assembly from the base unit.

The third embodiment 16 of the support base, illustrated in FIGS. 16–19, includes a lower or horizontal portion 160 configured to hold the tray 10 and cover 12 assembly in the same manner as the previously described base 14 and a second or vertical portion 162 located at the rear of the portion 160 and having shelves 164 and 166 for the reception of medicine bottles. A removeable, clear plastic cover 168 is, preferrably, provided for the upper portion 162. The rearmost wall 170 of the lower portion 160 is inclined at a 45° angle as is the lowermost wall 172 of the upper portion 162. The adjacent edges of these two walls are joined by a web 174 which functions as a hinge, the base 16 being molded and packaged with the bottom of the lower portion 160 and the rear face of the upper portion 162 coplanar, as shown in FIG. 17. The wall 172 of the upper portion is formed with outwardly projecting, elongated lugs 176 one side of which has wall portions 178 of V-shaped cross-sectional configuration while wall 170 of the lower portion has corresponding aligned recesses 180 formed therein, the recesses including wall portions 182 of V-shaped cross-sectional configuration. These cooperating lugs and recesses serve to hold the upper portion 162 in its operative position, as shown in FIG. 16, the wall portions 172, 182 functioning in the same manner as the latches described above in connection with FIGS. 6–8.

A vacuum thermoforming process may again be employed to fabricate each of the base units 14, 15 and 16 of, for example, high impact polystyrene.

In use of the pill tray and support of the invention described above, the tray 10 is normally retained in the base portion 44 of the case 12 but may be removed therefrom for example, for cleaning. When used at home, the tray and case assembly is snapped into position in one of the support bases 14, 15 or 16, the notched portion 132 or front opening 158 allowing ready access to the tabs 64 and 80 so that the case may be opened or closed without removing the assembly from the base unit. On a weekly basis, the tray may be filled with medication dosages arranged by time and day of taking. When traveling, the tray and case assembly may be removed from the supporting base and carried separately or without the base. As the cover tightly fits the tray with the indentations 68 sealing the individual compartments 20, pills or the like are confined within appropriate ones of the compartments.

The V-shaped configuration of the mating front and rear walls of the base portion and cover of the case provide a simple and effective latch mechanism particularly adapted for components made by thermoforming of plastic materials.

Figure 20:
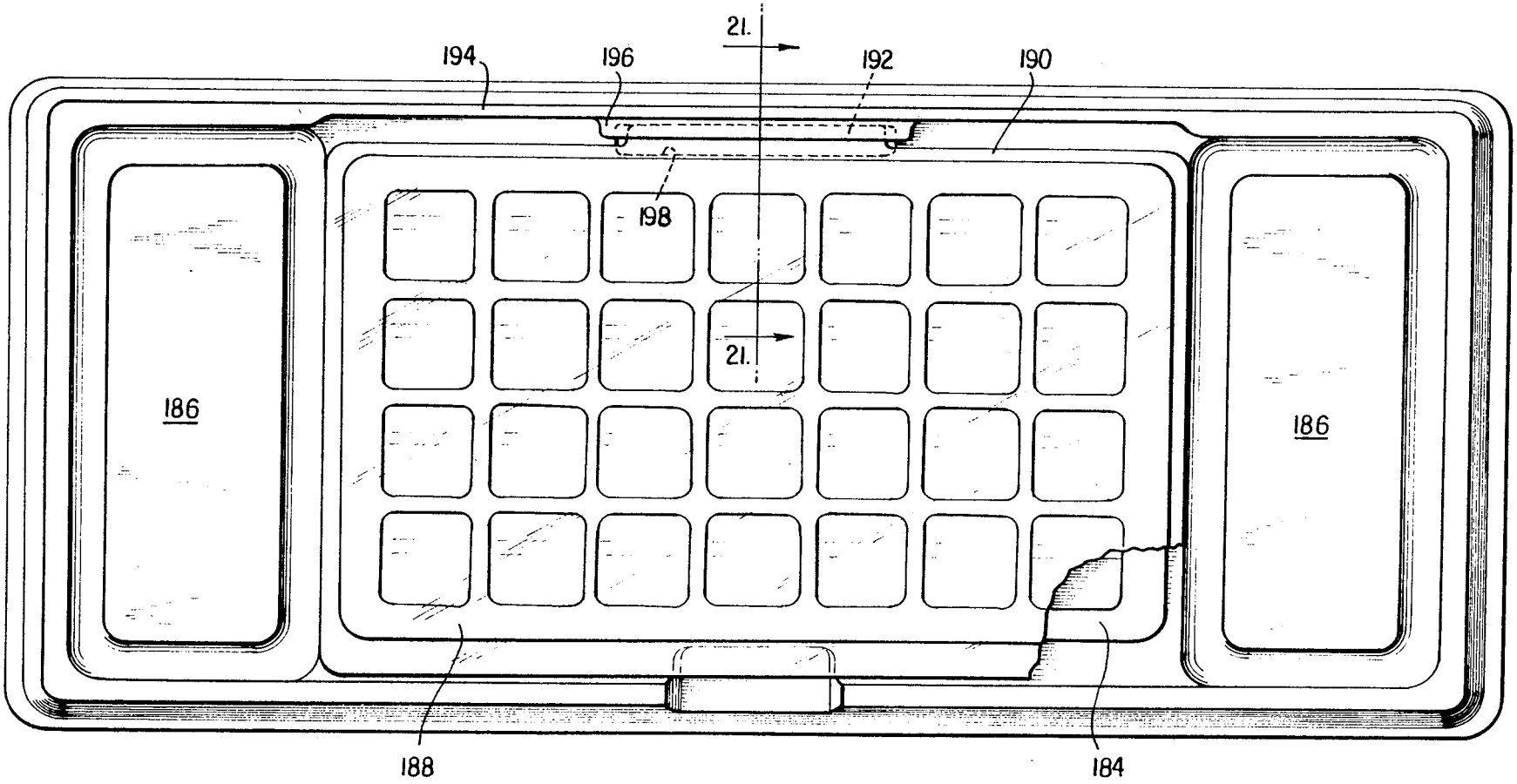
FIG. 20 is a plan view of a further modification of the pill tray and support base of the present invention.

Having reference now to FIGS. 20 and 21, a further modification of the tray assembly of the present invention will be described. In this embodiment, the compartmented tray 184 is formed integrally with the base unit, the tray portion being centrally located and flanked by medicine container storage recesses 186. A clear plastic cover 188 is provided for the tray portion. Projecting rearwardly from the back wall 190 of the cover is a tab 192. The adjacent rear wall 194 of the base unit is formed with a forwardly projecting lug 196 and, below the lug, with an opening 198, the lug and opening being aligned with the tab so that the tab extends beneath the lug when the cover is closed while the opening provides clearance therefor when the cover is swung upwardly to provide access to the compartments. This arrangement funciions as a simple hinge for the cover while permitting removal of the cover when desired.

It will be understood that while preferred embodiments of the invention have been illustrated and described, the invention is not limited to such embodiments as changes and additions may be made therein and thereto without departing from the spirit of the invention, Reference should, accordingly, be had to the appended claims in determining the true scope of the invention.

I claim:

1. A covered pill tray and support assembly comprising:

a tray of rectangular configuration having a plurality of open-topped compartments for the reception of individual dosages of pills and the like;

a case having a base portion adapted to receive said tray, a cover adapted to overly said tray, a hinge integral with said base portion and said cover and connecting the same along one edge thereof, and latch means for releasably holding said cover in closed position on said base portion;

a support base having upwardly extending front, rear and side walls defining a region for reception of said tray and two additional regions for the reception of medication containers, said additional regions being located laterally of said firstmentioned region and being defined by said side walls, lateral extensions of said front and rear walls and further side walls; and cooperating means on said case and said supporting base for releasably retaining said tray and case in said supporting base.

2. The covered pill tray and support assembly of claim 1 wherein said base portion of said case includes a bottom wall; side, front and rear walls extending upwardly from said bottom wall; a flange projecting outwardly from said side, front and rear walls; and depending walls extending from the outer edge of said flange and of lesser height than said side, front and rear walls; said cover includes a top wall and downwardly extending peripheral side, front and rear walls of substantially the same height as said depending walls; and said latch means comprises complementary portions of said depending front wall and said peripheral front wall.

3. The covered pill tray and support assembly of claim 2 wherein said complementary portions are each comprised of upper and lower wall portions of equal height, forming equal angles with the vertical and meeting at a common line to form a V-shaped cross-sectional configuration.

4. The covered pill tray and support assembly of claim 3 wherein said latch means further includes complementary portions of said depending rear wall and said peripheral rear wall of the same configuration as said complementary portions of said depending front wall and said peripheral front wall.

5. The covered pill tray and support assembly of claim 1 wherein said base portion of said case has front and rear walls and said cooperating means comprises outwardly extending projections on said front and rear walls of said case and complementary recesses in the corresponding upwardly extending walls of said support base.

6. The covered pill tray and support assembly of claim 5 wherein each of said projections has upper and lower wall portions of equal height, forming equal angles with the vertical and meeting at a common line to form a V-shaped cross-sectional configuration.

7. A covered pill tray and support assembly comprising:

a tray of rectangular configuration having a plurality of open-topped compartments for the reception of individual dosages of pills and the like;

a case having a base portion adapted to receive said tray, a cover adapted to overly said tray, a hinge integral with said base portion and said cover and connecting the same along one edge thereof, and latch means for releasably holding said cover in closed position on said base portion;

a support base having upwardly extending front, rear and side walls defining a region for reception of said tray and case and including an upwardly extending portion including at least one horizontal wall defining a shelf for reception of medication containers; and cooperating means on said case and said supporting base for releasably retaining said tray and case in said supporting base.

8. The covered pill tray and support assembly of claim 7 wherein said upwardly extending portion is connected to said tray and case receiving region by hinge means and said assembly includes means for securing said upwardly extending portion in operative position.

9. In a thermoformed plastic construction having a base portion with front and rear walls, a cover portion with front and rear walls adapted to overly the corresponding walls of said base portion in abutting relation and hinge means interconnecting said portions along the rear walls thereof, a latch mechanism comprising:

a region of said front wall of said base portion of V-shaped cross-section including upper and lower portions df equal height and forming equal angles with the vertical; and a region of said front wall of said cover portion in alignment with said region of said front wall of said base portion when said cover portion is closed upon said base portion and of the same configuration thereas.

10. The latch mechanism of claim 9 wherein regions of V-shaped cross-section including upper and lower portions of equal height and forming equal angles with the vertical are provided on the abutting portions of said rear walls of said base and cover portions.

11. In a thermoformed plastic construction having a pair of members adapted to be releaseably interconnected and each having a wall, said walls being in abutting relation when said members are interconnected, a latch mechanism for releaseably interconnecting said members comprising:

a region of said wall of one said member of V-shaped cross-section including upper and lower portions of equal height and forming equal angles with the vertical; and a region of said wall of the other said member in alignment with said region of said one wall when said members are interconnected and of the same configuration thereas.

* * * * *